US010249957B2

(12) United States Patent
Chang et al.

(10) Patent No.: US 10,249,957 B2
(45) Date of Patent: Apr. 2, 2019

(54) WIRELESS COMMUNICATION DEVICE

(71) Applicant: Wistron NeWeb Corporation, Hsinchu (TW)

(72) Inventors: Wei-Shan Chang, Hsinchu (TW); Guan-Nan Lin, Hsinchu (TW); Chia-Tien Li, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 245 days.

(21) Appl. No.: 14/680,052

(22) Filed: Apr. 6, 2015

(65) Prior Publication Data

US 2016/0294067 A1 Oct. 6, 2016

(51) Int. Cl.

| | |
|---|---|
| ***H01Q 13/18*** | (2006.01) |
| ***H01Q 5/364*** | (2015.01) |
| ***H01Q 1/22*** | (2006.01) |
| ***H01Q 1/24*** | (2006.01) |

(52) U.S. Cl.

CPC ..... *H01Q 13/18* (2013.01); *H01Q 5/364* (2015.01); *H01Q 1/2266* (2013.01); *H01Q 1/243* (2013.01)

(58) Field of Classification Search

CPC ..... H01Q 13/18; H01Q 5/364; H01Q 1/243; H01Q 1/2266

See application file for complete search history.

(56) References Cited

U.S. PATENT DOCUMENTS

| | | | | |
|---|---|---|---|---|
| 7,551,142 | B1 * | 6/2009 | Zhang | H01Q 1/243 343/700 MS |
| 2008/0165063 | A1 * | 7/2008 | Schlub | H01Q 1/243 343/702 |
| 2012/0068893 | A1 * | 3/2012 | Guterman | H01Q 1/2266 343/702 |
| 2014/0009342 | A1 * | 1/2014 | Wei | H01Q 1/2266 343/700 MS |
| 2015/0270619 | A1 * | 9/2015 | Zhu | H01Q 13/10 343/702 |

* cited by examiner

*Primary Examiner* — Hai V Tran
*Assistant Examiner* — Michael M Bouizza
(74) *Attorney, Agent, or Firm* — Winston Hsu

(57) ABSTRACT

A wireless communication device includes a metal cover and an antenna. The metal cover is formed with a slot. The antenna is disposed in the metal cover for resonating a radio-frequency signal via the slot, and includes a feed terminal, a radiator and a ground. The feed terminal is used for feeding the radio-frequency signal. The radiator includes a first arm electrically connected to the feed terminal and extended from the feed terminal along a first direction, and a second arm electrically connected to the first arm and extended from the first arm along a second direction, wherein the second arm is partially overlapped with a first edge of the slot.

8 Claims, 9 Drawing Sheets

WIRELESS COMMUNICATION DEVICE

BACKGROUND OF THE INVENTION

1. Field of the Invention

The present invention relates to a wireless communication device, and more particularly, to a wireless communication device having an antenna for resonating radio-frequency signals via a slot of a metal cover of the wireless communication device.

2. Description of the Prior Art

An antenna is used for transmitting or receiving radio waves, to communicate or exchange wireless signals. An electronic product with a wireless communication function, such as a laptop, a personal digital assistant (PDA), etc., usually accesses a wireless network through a built-in antenna. Therefore, for facilitating a user to access the wireless communication network, an ideal antenna should have a wide bandwidth and a small size to meet the trend of compact electronic products, so as to integrate the antenna into a portable wireless communication device. In addition, an ideal antenna should cover different frequency bands required for different wireless communication networks.

The portable wireless communication device may utilize a metal housing or a metal cover for decoration and robustness, which may cause decreased antenna gain, narrowed bandwidth or unstable antenna performance due to the metal housing or cover. In such a situation, a designer not only faces a challenge of the antenna performance but also has to take integration between the antenna and the metal cover into consideration when integrating the antenna into the portable wireless communication device.

Therefore, how to design a wideband antenna to adapt to a mechanical design of the wireless communication device when integrating the antenna into the wireless communication device has become a goal in the industry.

SUMMARY OF THE INVENTION

It is therefore an objective of the present invention to provide a wireless communication device having an antenna for resonating radio-frequency signals via a slot of a metal cover of the wireless communication device so as to adapt to mechanical design.

An embodiment of the present invention discloses a wireless communication device including a metal cover and an antenna. The metal cover is formed with a slot. The antenna is disposed in the metal cover for resonating a radio-frequency signal via the slot, and includes a feed terminal, a radiator and a ground. The feed terminal is coupled between the ground and the radiator and used for feeding the radio-frequency signal. The radiator includes a first arm electrically connected to the feed terminal and extended from the feed terminal along a first direction, and a second arm electrically connected to the first arm and extended from the first arm along a second direction, wherein the second arm is partially overlapped with a first edge of the slot, and the first direction is perpendicular to the second direction.

An embodiment of the present invention discloses a wireless communication device including a metal cover and an antenna. The metal cover is formed with a slot. The antenna is disposed in the metal cover for resonating a radio-frequency signal via the slot, and includes a feed terminal, a radiator and a ground. The feed terminal is used for feeding the radio-frequency signal. The radiator includes a first arm electrically connected to the feed terminal and extended from the feed terminal along a first direction, a second arm electrically connected to the first arm and extended from the first arm along a second direction, and a third arm electrically connected to the first and second arms and extended from the first and second arms along the second direction, wherein the first direction is perpendicular to the second direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
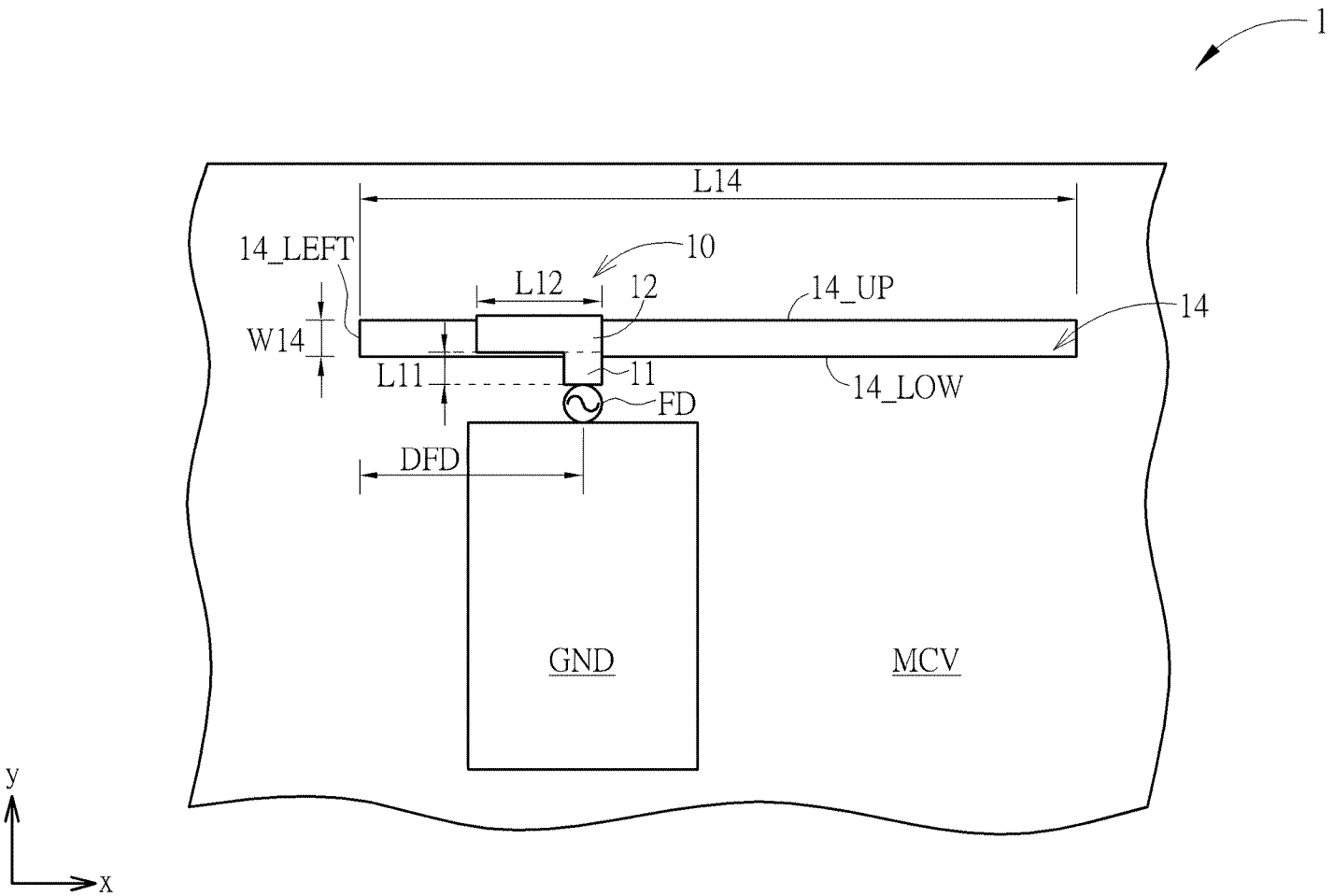
FIG. 1 illustrates a part of a wireless communication device according to a first embodiment of the present invention.

Please refer to FIG. 1, which illustrates a part of a wireless communication device 1 according to a first embodiment of the present invention. The wireless communication device 1 may be an electronic device capable of performing wireless communication, such as a tablet computer, a laptop computer, a mobile phone, a personal digital assistant, and so on.

In structure, the wireless communication device 1 includes a metal cover MCV and at least one antenna 10. A slot 14 may be an enclosed resonant cavity formed in the metal cover MCV, such that the antenna 10 may resonate a radio-frequency signal via the slot 14. The radio-frequency signal may include at least two signal components corresponding to different operating bands to support IEEE standards 802.11 a/b/g both in 2.4 G and 5 G bands.

The antenna 10 may be disposed in the metal cover MCV, and includes a feed terminal FD, a radiator including arms 11 and 12, and a ground GND. The feed terminal FD may be coupled between the ground GND and the arm 11, and used for feeding the radio-frequency signal. The arm 11 may be electrically connected to the feed terminal FD and extended from the feed terminal FD along a y-direction. The arm 12 is electrically connected to the arm 11 and extended from the arm 11 along an x-direction, wherein the arm 12 is partially overlapped with an upper edge 14_UP of the slot 14 to induce a coupling effect between the arm 12 and the slot 14. The ground GND may be a metal sheet to be pasted on the metal cover MCV. The y-direction is perpendicular to the x-direction.

A length L14 of the slot 14 may be substantially a half wavelength $\lambda_g/2$ of a first signal component of the radio-frequency signal (L14=$\lambda_g/2$ for 2.4 G band). A width W14 of the slot 14 may be substantially smaller than a 1/25 wavelength $\lambda_g$ of the first signal component (W14<$\lambda_g/25$ for 2.4 G band), the wavelength $\lambda_g$ may be obtained according to the following equations.

$$\lambda_g(\text{mm}) = \frac{300}{f_r(\text{GHz})\sqrt{\varepsilon_{eff}}}; \quad (1)$$

$$\varepsilon_{eff} = \frac{1+\varepsilon_r}{2} \quad (2)$$

$\lambda_g$: A wavelength in a medium (i.e. the metal cover MCV).
$f_r$: Resonant frequency.
$\varepsilon_r$: Dielectric constant of the medium.
$\varepsilon_{eff}$: Effective dielectric constant of the medium.

The arm 11 may have a length L11, the arm 12 may have a length L12, and a sum of the lengths L11 and L12 may be substantially a quarter wavelength of a second signal component of the radio-frequency signal. A distance DFD is between a left edge 14_LEFT of the slot 14 and the feed terminal FD, for resonating the second signal component of the radio-frequency signal (5 G band), half of the wavelength $\lambda_g$ may be a sum of twice the distance DFD and the width W14, i.e. ($\lambda_g/2$)=2*DFD+W14, for 5 G band.

Note that the radiator of the antenna 10 (i.e. a combination of arms 11 and 12) may be regarded as a bended monopole radiator. In other words, the banded monopole radiator may be a feed network for feeding the radio-frequency signal to the slot 14 via the coupling effect such that the antenna 10 may be operative as a slot antenna. From another point of view, since the metal cover MCV is formed with the slot 14, the metal cover MCV may be regarded as a radiator of the slot antenna to resonate the radio-frequency signal.

In operation, during transmission and reception operations of the wireless communication device 1, the radio-frequency signal is fed to the feed terminal FD, and the antenna 10 may directly radiate the radio-frequency signal to the air via the banded monopole radiator. Meanwhile, since the slot 14 forms the closed resonant cavity, the coupling effect may be induced between the arm 12 and the slot 14 to radiate the radio-frequency signal via the coupling effect. Therefore, the antenna 10 may radiate the radio-frequency signal via direct radiation and the coupling effect to perform wireless communication.

As a result, the present invention utilizes a part of the metal cover MCV as the radiator of the antenna 10 to effectively utilize mechanical parts of the wireless communication device 1, such that the metal cover MCV may have versatile functions such as decoration, endurance, and wireless signal radiation, so as to cleverly integrate the antenna 10 in the wireless communication device 1 and adapt to mechanical designs.

Figure 2:
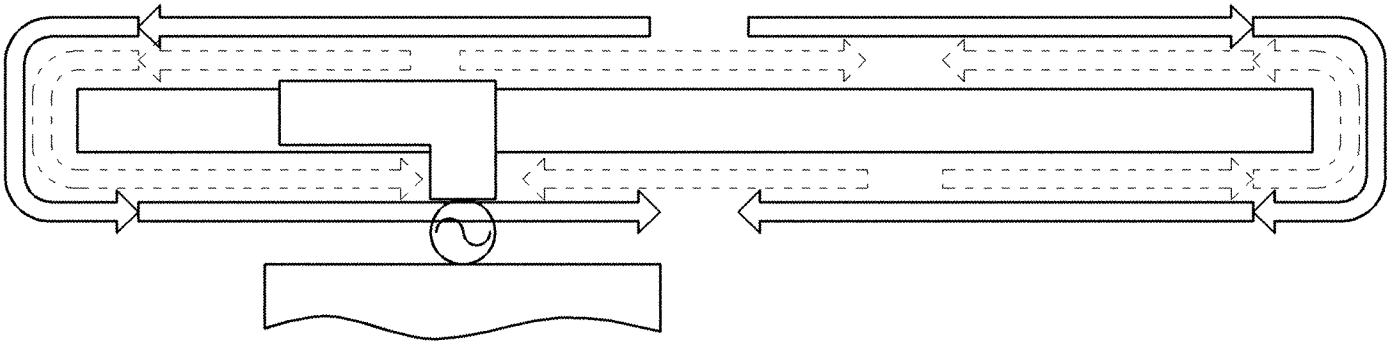
FIG. 2 illustrates radio-frequency current routes on the antenna shown in FIG. 1.

Please refer to FIG. 2, which illustrates radio-frequency current routes on the antenna 10. The current routes of the signal components at 2.4 G and 5 G bands are denoted with blank and dashed arrows, respectively. As shown in FIG. 2, the two current routes of the signal component at 2.4 G start from the middle of the upper edge 14_UP of the slot 14, with which the arm 12 is partially overlapped, and return to the middle of a lower edge 14_LOW of the slot 14. The two current routes of the signal component at 2.4 G may be symmetrically encircled around the slot 14.

On the other hand, the current routes of signal component at 5 G band looks quite complicated, this is because the distance DFD shown in FIG. 1 may determine lengths of the current routes distributed around the slot 14. A length of the current route from where the arm 12 and the slot 14 are overlapped to the feed terminal FD may be substantially a quarter wavelength of the second signal component of the radio-frequency signal to excite or radiate the second signal component (5 G band).

Therefore, a relative location between the feed terminal DFD (or the radiator) and the slot 14 may be critical to matching for the second signal component at 5 G band, the antenna 10 may resonate the second signal component at 5 G band only when the distance DFD and the width W14 are properly chosen (($\lambda_g/2$)=2*DFD+W14, for 5 G band). In addition, based on specific sizes (e.g. lengths L11, L12, L14, width W14, and distance DFD), operating frequencies of the antenna 10 may be properly designed in order to adapt to wireless communication standards.

Note that the antenna 10 shown in FIG. 1 is an example of the present invention, those skilled in the art may make modifications and alterations accordingly. Sizes associated with the slot 14, the arms 11 and 12 may be properly adjusted or scaled according to practical requirement in order to adapt to certain operating frequencies, wherein sizes associated with the slot and the radiator may determine the frequencies of the first signal component at 2.4 G band, and sizes associated with the location of the feed terminal may determine the frequencies of the second signal component at 5 G band. Shapes of the radiator of the antenna may be adjusted without limitation. Additional arms, parasitic element, or passive elements (e.g. capacitors, resistors, or inductors) may be applied to the antenna 10 for better signal matching.

Figure 3:
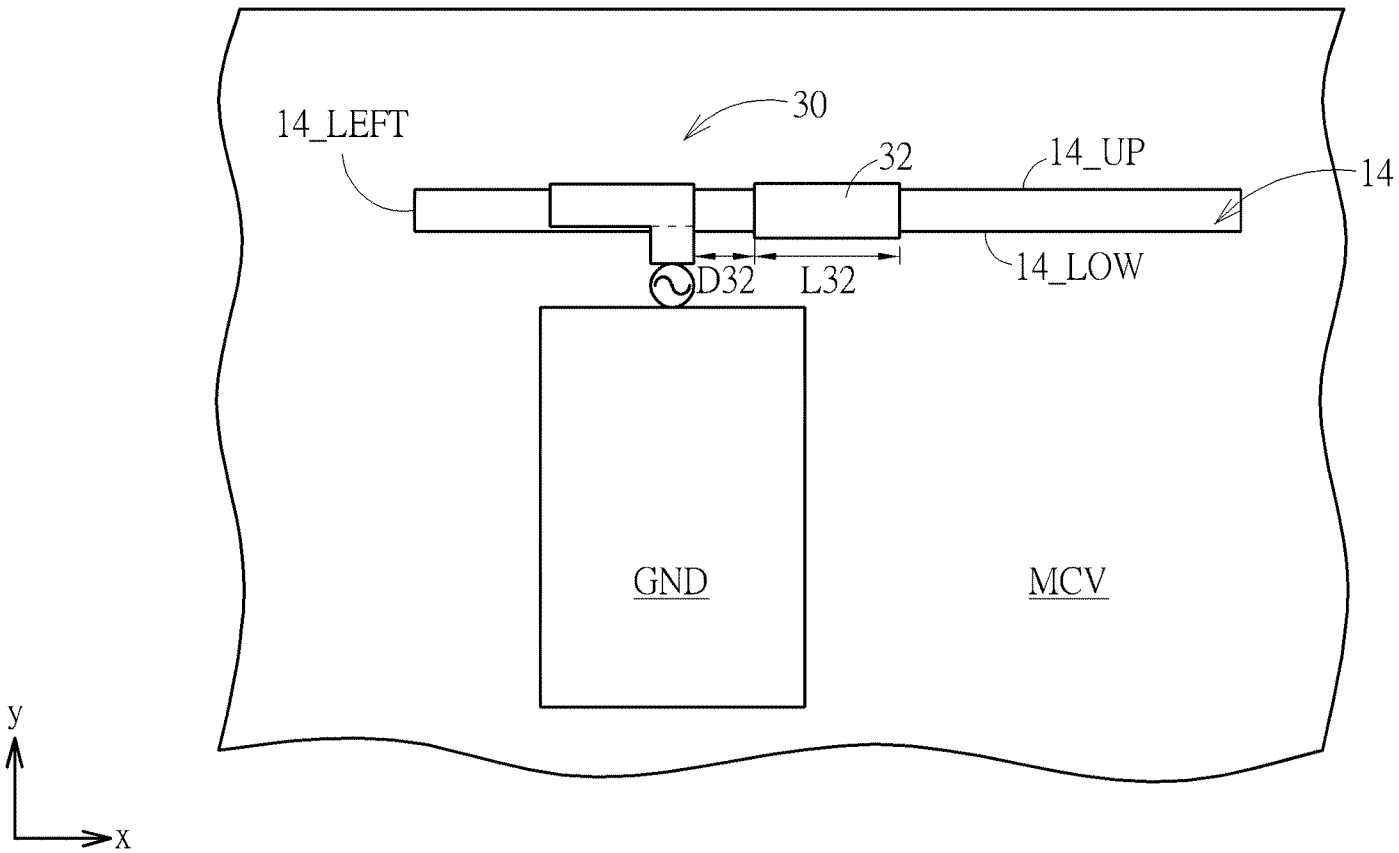
FIG. 3 illustrates a part of the wireless communication device according to a second embodiment of the present invention.

For example, please refer to FIG. 3, which illustrates a part of the wireless communication device 1 according to a second embodiment of the present invention. An antenna 30 may further include a parasitic element 32 for matching the second signal component of the radio-frequency (i.e. 5 G band). The parasitic element 32 may be partially overlapped with the upper and lower edges 14_UP and 14_LOW of the slot 14.

A center of the parasitic element 32 may be disposed in a center of the slot 14. With a longer length L32 of the parasitic element 32, the second signal component with lower frequencies may be induced to adapt to practical requirements. Note that antennas regarding every embodiment or alternatives in the invention may be combined with a parasitic element, which is not limited.

Figure 4:
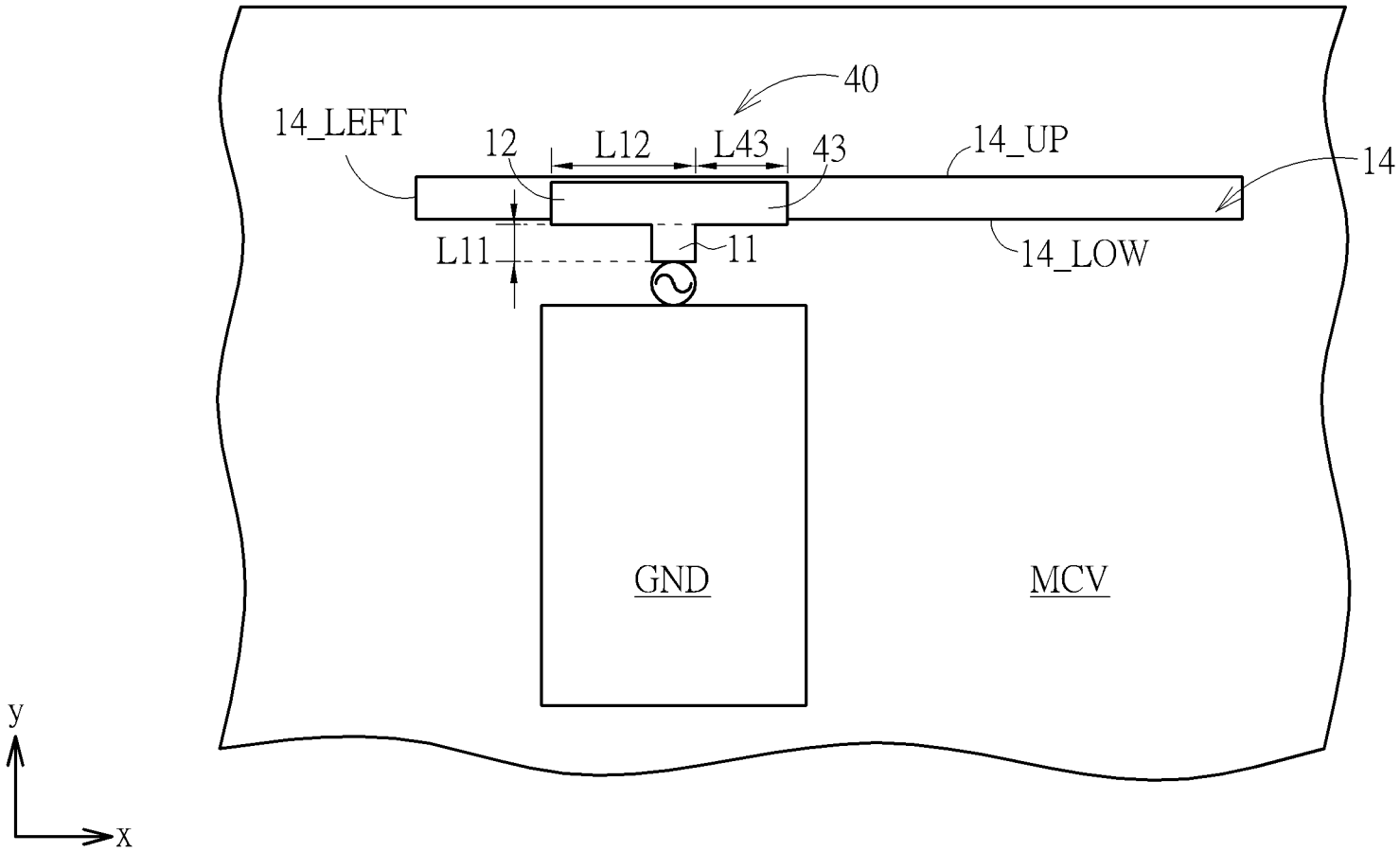
FIG. 4 illustrates a part of the wireless communication device according to a third embodiment of the present invention.

Please refer to FIG. 4, which illustrates apart of the wireless communication device 1 according to a third embodiment of the present invention. A radiator of an antenna 40 may include arms 11, 12 and 43. The arm 43 may be extended from where the arms 11 and 12 are connected along the x-direction and aligned with the arm 12, wherein the arms 12 and 43 may be partially overlapped with the lower edge 14_LOW of the slot 14. In such a structure, the radiator of the antenna 40 may have a T-shape, and the arm 43 may be used for radiating or exciting a third frequency component of the radio-frequency signal. The arm 43 may have length L43. A sum of the lengths L11 and L43 may be substantially a quarter wavelength of a third signal component of the radio-frequency signal.

Figure 5:
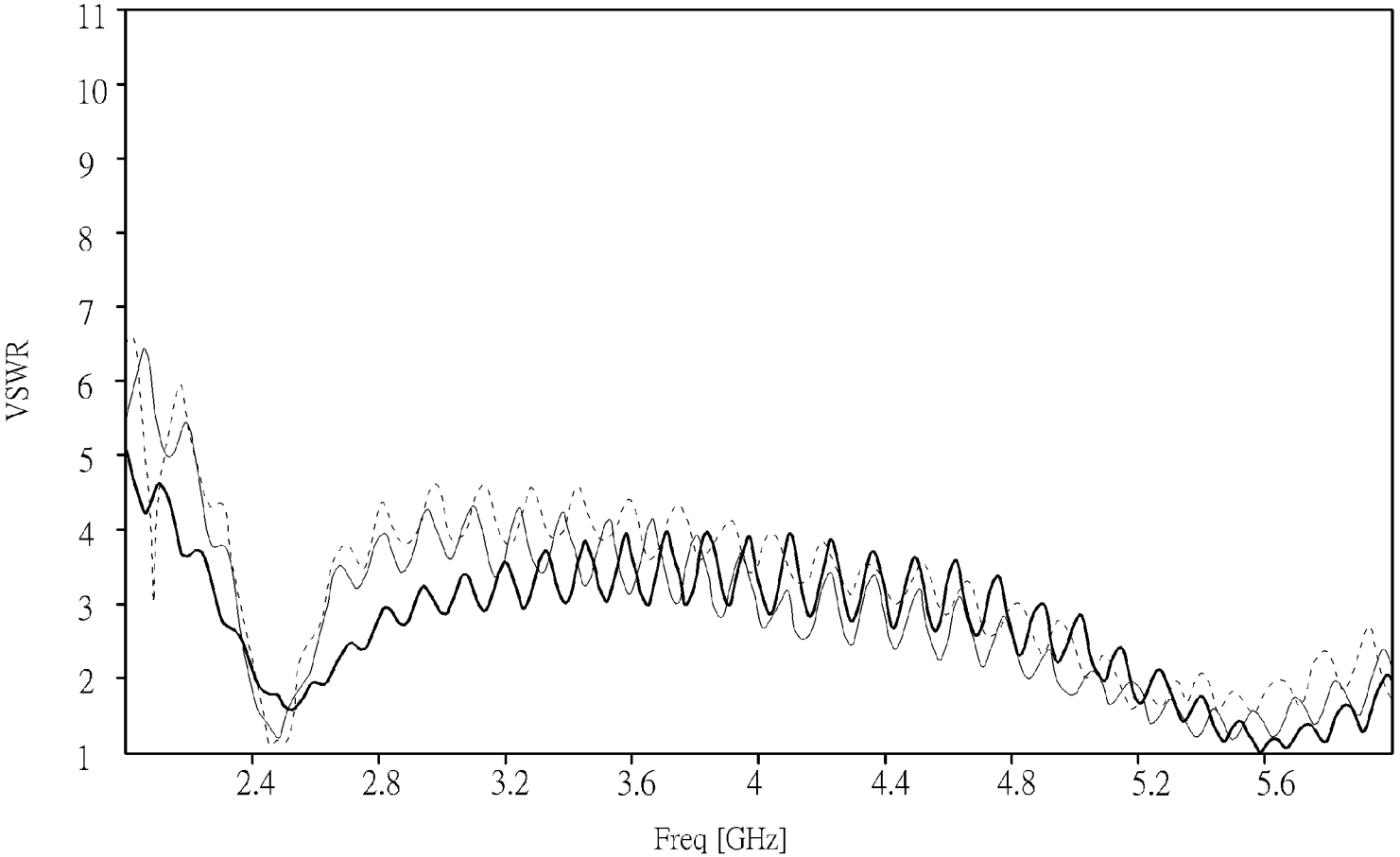
FIG. 5 illustrates a comparison of voltage standing wave ratios of the antennas shown in FIG. 1, FIG. 3 and FIG. 4.

Please refer to FIG. 5, which illustrates a schematic diagram of voltage standing wave ratios (VSWRs) of the antennas 10, 30 and 40. The VSWRs of the antenna 10, 30 and 40 are respectively denoted with a thin solid line, a bolded solid line, and a dash line. As can be seen, compare with the antenna 10, the antenna 30 with the parasitic element 32 may broaden a bandwidth for the signal component at 2.4 G band, while the antenna 40 with the T-shape radiator may resonate three signal components around central frequencies at 2.45 GHz, 5.2 GHz and 5.6 GHz. Real values of the VSWRs are summarized in the following Table 1.

TABLE 1

| Frequency (GHz) | Antenna 10 | Antenna 30 | Antenna 40 |
|---|---|---|---|
| 2.4 | 1.7720 | 2.0995 | 1.8881 |
| 2.5 | 1.3328 | 1.6532 | 1.0805 |
| 5.15 | 1.8748 | 2.3717 | 1.2951 |
| 5.85 | 1.7589 | 1.6824 | 1.4668 |

Figure 6:
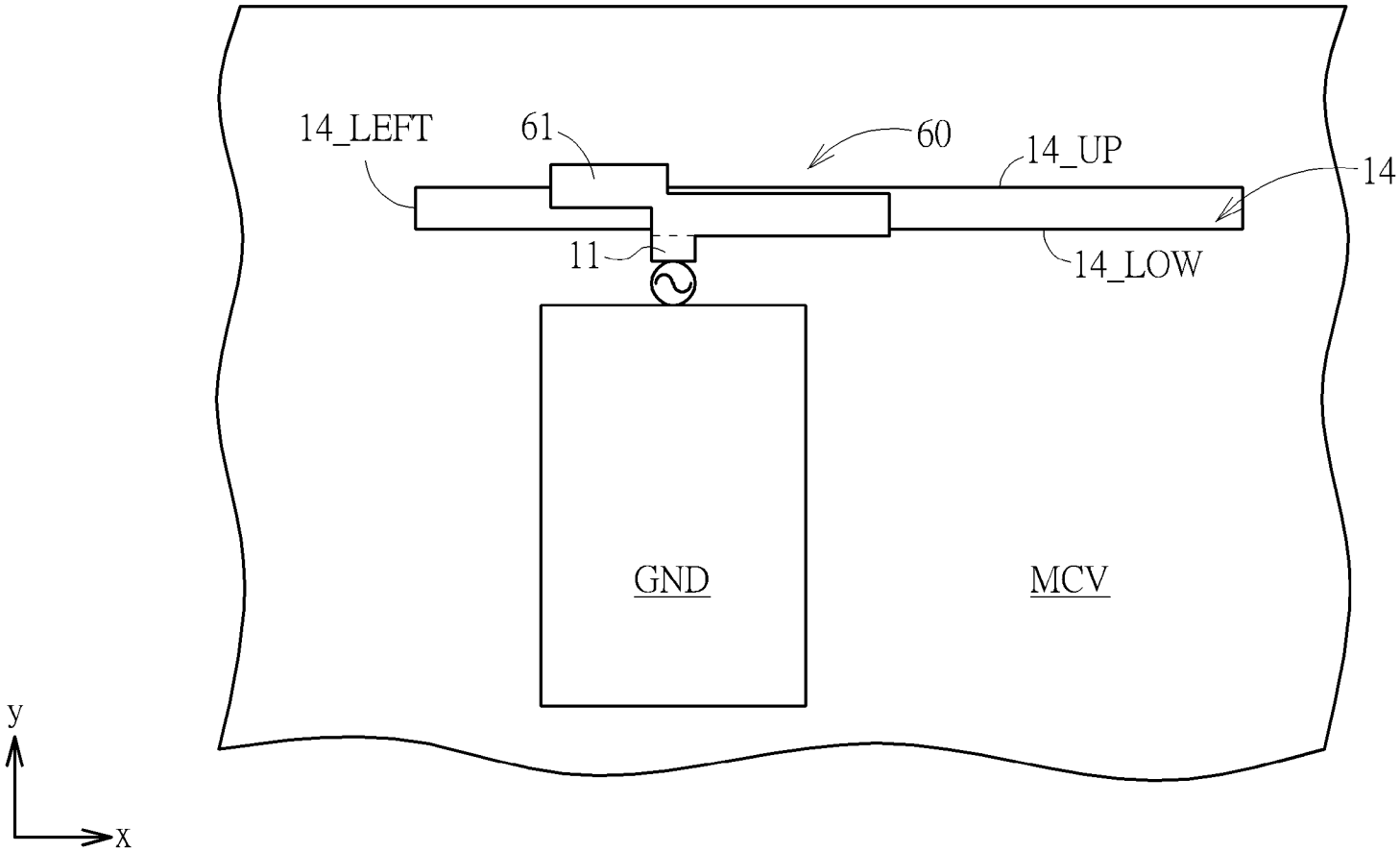
FIG. 6 illustrates a part of the wireless communication device according to a fourth embodiment of the present invention.

Please refer to FIG. 6, which illustrates a part of the wireless communication device 1 according to a fifth embodiment of the present invention. A radiator of an antenna 60 may include arms 11 and 61. The arm 61 may be electrically connected to the arm 11, extend along the x-direction, and have a ladder-shape. The arm 61 may be partially overlapped with the upper and lower edges 14_UP and 14_LOW of the slot 14.

Figure 7:
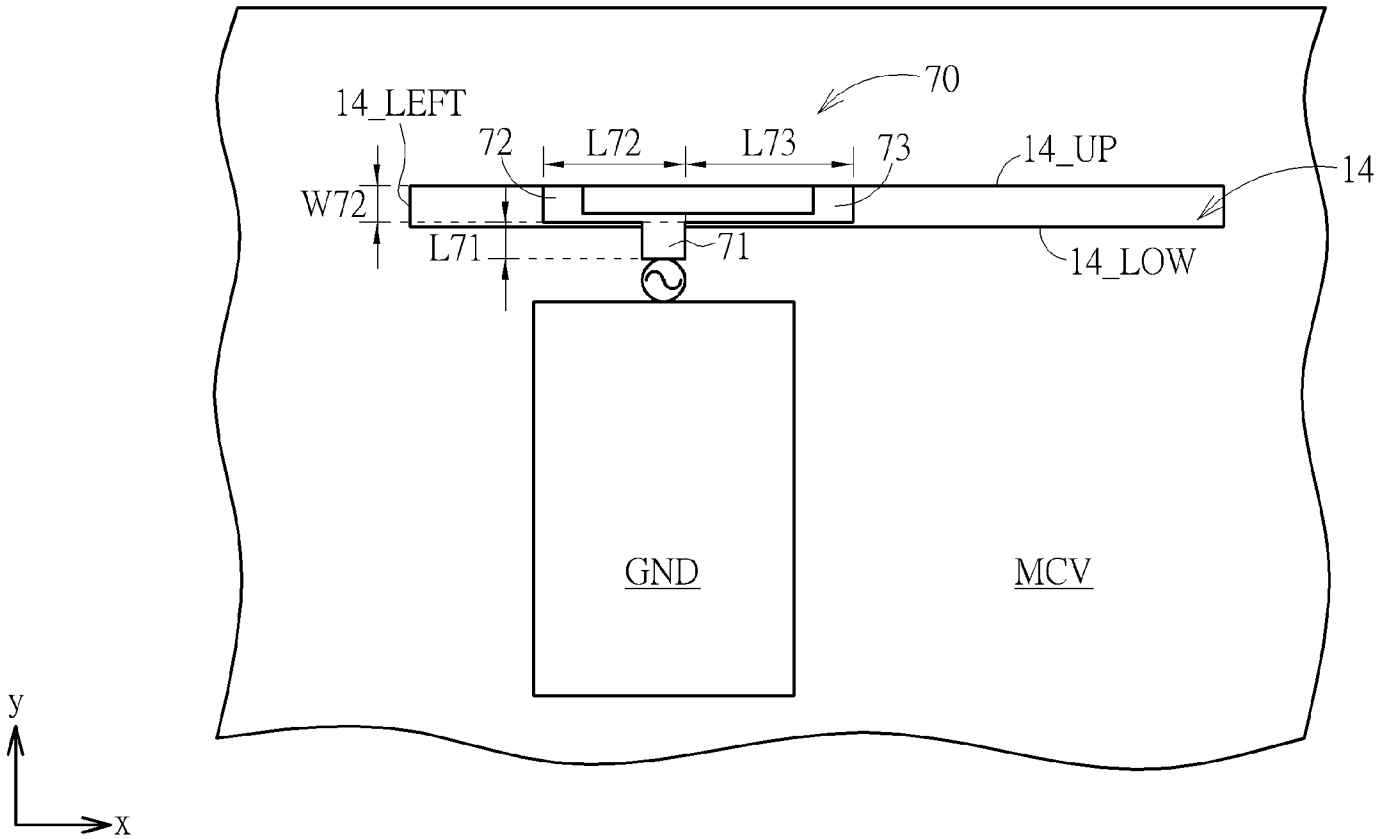
FIG. 7 illustrates a part of the wireless communication device according to a fifth embodiment of the present invention.

Please refer to FIG. 7, which illustrates a part of the wireless communication device 1 according to a fourth embodiment of the present invention. A radiator of an antenna 70 may include arms 71, 72 and 73. One end of the arm 71 may be electrically connected to the feed terminal FD, another end thereof may be electrically connected to the arms 72 and 73, and the arm 71 may extend from the feed terminal FD along the y-direction. The arms 72 and 73 may have a bend, such that the radiator may have a fork-shape.

Note that the arms 72 and 73 may be completely located inside the slot 14, which is different from radiators of the antenna 10, 30, 40, 60 and 70 being partially overlapped with the upper and/or lower edges 14_UP and/or 14_LOW of the slot 14. In other words, a width W72 of the arms 72 and 73 may be smaller than the width W14 of the slot 14. In another embodiment, the width W72 may be equal to the width W14 of the slot 14. The arms 71, 72 and 73 may have lengths L71, L72 and L73, respectively. A sum of the width W72 and the lengths 71 and 72 may be substantially a quarter wavelength of the second signal component of the radio-frequency signal, and a sum of the width W72 and the lengths L71 and L73 may be substantially a quarter wavelength of a third signal component of the radio-frequency signal. In one embodiment, the arms 72 and 73 may be straight bars, such that the radiator may have a T shape.

Figure 8:
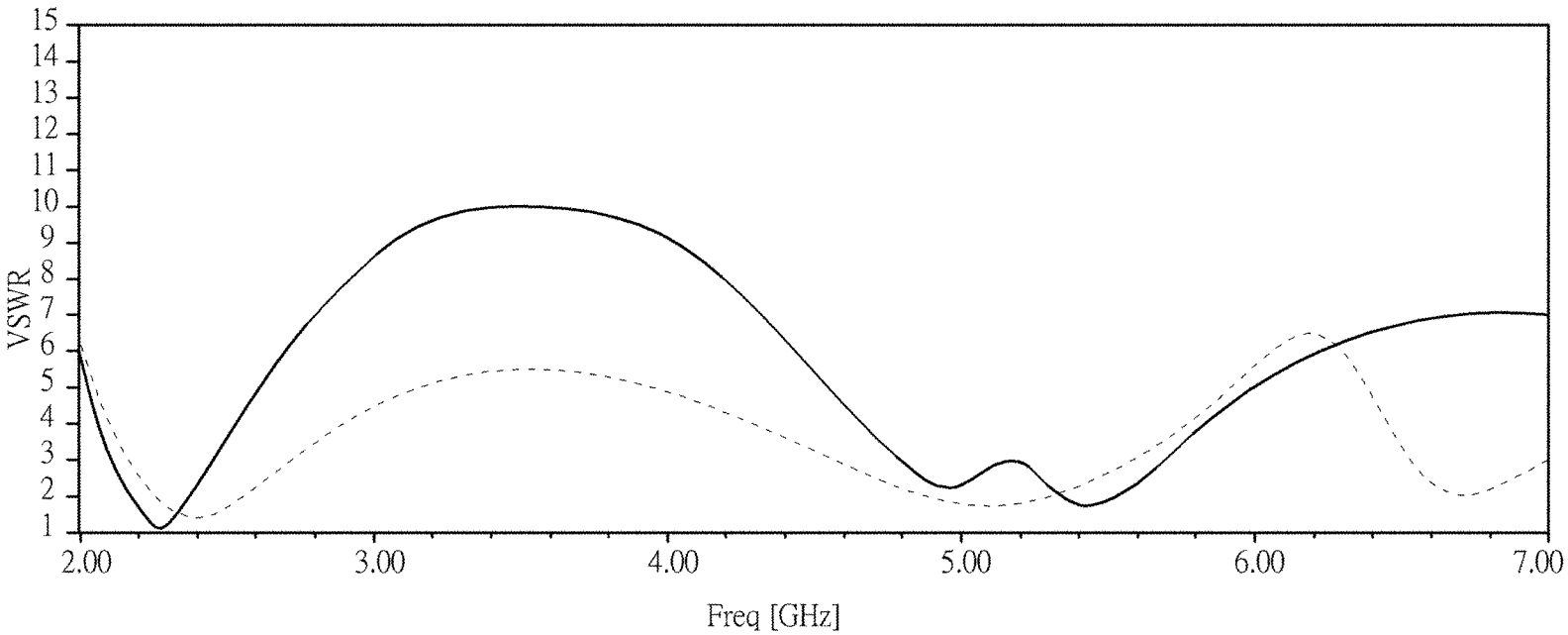
FIG. 8 illustrates a comparison of voltage standing wave ratios of the antennas shown in FIG. 6 and FIG. 7.

Please refer to FIG. 8, which illustrates a schematic diagram of VSWRs of the antennas 60 and 70. The VSWRs of the antennas 60 and 70 are respectively denoted with a solid line and a dash line. As can be seen, both the antennas 60 and 70 may resonate two signal components at high frequencies greater than 4.5 GHz. The two signal components at high frequencies for the antenna 60 are comparatively closer (around central frequencies 5.1 GHz and 6.7 GHz with 1.6 GHz difference); while the two signal components at high frequencies for the antenna 70 are farther from each other (around central frequencies 4.9 GHz and 5.4 GHz with 0.5 GHz difference).

Therefore, with the various (first to fifth) embodiments of the present invention, operating frequencies and bandwidths of the antenna may be properly adjusted to adapt to practical requirements, which may broaden an application range of the wireless communication device to support multiple wireless communication standards.

Figure 9:
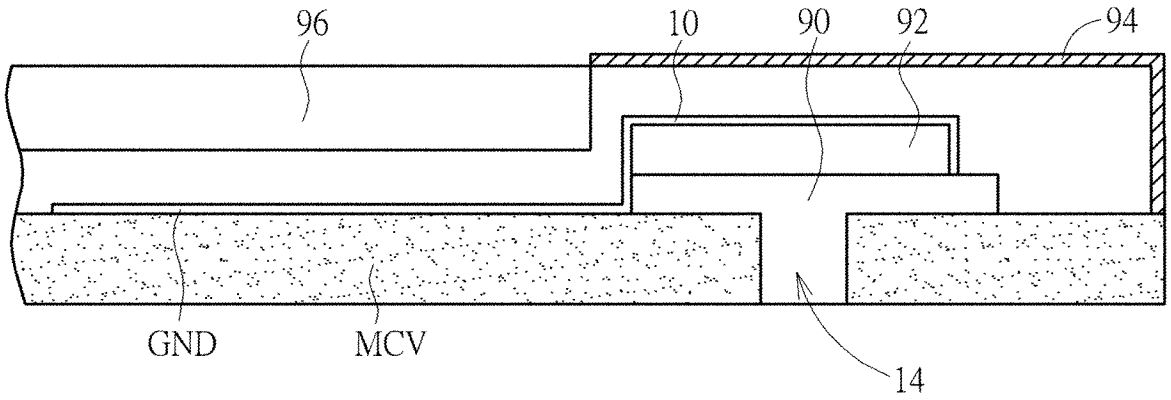
FIG. 9 illustrates a side view of a stack of the wireless communication device shown in FIG. 1.

For implementation, please refer to FIG. 9, which illustrates a side view of a stack of the wireless communication device 1. Assume that the communication device 1 is a tablet computer, and includes the metal cover MCV, a decoration cover 94 and a display 96, and take the antenna 10 for example. The radiator including the arms 11 and 12 may be formed on a printed circuit board (PCB) 92 via printing or a laser direct structuring (LDS) technology. The antenna 10 may further include a holder 90 for filling the slot 14 and supporting the printed circuit board 92, which may protect the antenna 10 from deformation due to external forces applied to the metal cover MCV or the decoration cover 94. In one embodiment, the arms 11 and 12 may be metal sheet attached to or pasted on the holder 90. In such a structure, the antenna 10 may be integrated in the wireless communication device 1 and adapt to mechanical designs.

To sum up, the present invention utilizes a part of the metal cover to be the radiator of the antenna to effectively utilize mechanical parts of the wireless communication device, such that the metal cover may have versatile functions such as decoration, endurance, and wireless signal radiation, so as to cleverly integrate the antenna in the wireless communication device and adapt to mechanical designs. The present invention further provides design principle in sizes associated with the antenna in order to adapt to certain operating frequencies, wherein sizes associated with the slot and the radiator may determine the frequencies of the first signal component at 2.4 G band, and sizes associated with the location of the feed terminal may determine the frequencies of the second signal component at 5 G band.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wireless communication device, comprising:

a metal cover that is capable of a first radiator formed with a slot; and an antenna disposed in the metal cover for resonating a radio-frequency signal via the slot, comprising:

a feed terminal for feeding the radio-frequency signal;

a second radiator configured to feed the radio-frequency signal to the first radiator via inducing a coupling effect between the second radiator and the slot, and comprising a first arm electrically connected to the feed terminal and extended from the feed terminal along a first direction, and a second arm electrically connected to the first arm and extended from the first arm along a second direction, wherein the second arm is partially overlapped with a first edge of the slot and a length of the second arm is smaller than a length of the slot along the second direction; and a ground, wherein the feed terminal is coupled between the ground and the second radiator;

wherein the first direction is perpendicular to the second direction;

wherein the antenna further comprises a third arm electrically connected to the first and second arms and extended from wherein the first and second arms are connected along the second direction;

wherein the third arm is aligned with the second arm along the second direction, the second radiator has a T-shape, and the second arm and the third arm are only overlapped with the first edge of the slot.

2. The wireless communication device of claim 1, wherein the length of the slot is substantially a half wavelength of a first signal component of the radio-frequency signal.

3. The wireless communication device of claim 2, wherein a width of the slot is substantially smaller than 1/25 wavelength of the first signal component of the radio-frequency signal.

4. The wireless communication device of claim 2, wherein a sum of the lengths of the first and second arms is substantially a quarter wavelength of a second signal component of the radio-frequency signal.

5. The wireless communication device of claim 2, wherein a first distance is between a third edge of the slot and the feed terminal, and a half wavelength of a second signal component is substantially a sum of twice the first distance and the width of the slot.

6. The wireless communication device of claim 1, wherein the antenna further comprises a parasitic element partially overlaps with the first edge and a second edge of the slot, and a center of the parasitic element is disposed in a center of the slot.

7. The wireless communication device of claim 1, wherein a sum of the length of the first arm and a length of the third arm is substantially a quarter wavelength of a third signal component of the radio-frequency signal.

8. A wireless communication device, comprising:

a metal cover that is capable of a first radiator formed with a slot; and an antenna disposed in the metal cover for resonating a radio-frequency signal via the slot, comprising:

a feed terminal for feeding the radio-frequency signal;

a second radiator configured to feed the radio-frequency signal to the first radiator via inducing a coupling effect between the second radiator and the slot, and comprising a first arm electrically connected to the feed terminal and extended from the feed terminal along a first direction, and a second arm electrically connected to the first arm and extended from the first arm along a second direction, wherein the second arm is partially overlapped with a first edge of the slot and a length of the second arm is smaller than a length of the slot along the second direction; and a ground, wherein the feed terminal is coupled between the ground and the second radiator;

wherein the first direction is perpendicular to the second direction;

wherein the second arm has a ladder-shape, and a part of the second arm is only overlapped with the first edge of the slot, and another part of the second arm is only overlapped with a second edge of the slot opposite to the first edge of the slot.

* * * * *